US005609378A

United States Patent [19]

Bowers et al.

[11] Patent Number: 5,609,378

[45] Date of Patent: Mar. 11, 1997

[54] AUTOMATIC CRANE HOOK SAFETY LATCH

[75] Inventors: Peter Bowers; Stephen Hart, both of Oroville, Calif.

[73] Assignee: Latchit Enterprises, Inc., Oroville, Calif.

[21] Appl. No.: 519,190

[22] Filed: Aug. 25, 1995

[51] Int. Cl.[6] ..... B66C 1/36

[52] U.S. Cl. ..... 294/82.19; 294/82.3; 294/905

[58] Field of Search ..... 294/82.17, 82.19, 294/82.2, 82.21, 82.24, 82.3, 82.31, 82.33, 82.35, 905

[56] References Cited

U.S. PATENT DOCUMENTS

| | | | |
|---|---|---|---|
| 1,711,346 | 4/1929 | Greve | 294/82.19 |
| 2,868,581 | 1/1959 | Minty et al. . | |
| 2,942,743 | 6/1960 | Dempster | 294/82.19 |
| 3,008,210 | 11/1961 | Stovern | 294/82.19 |
| 3,154,337 | 10/1964 | Walker . | |
| 3,177,028 | 4/1965 | Cozzoli . | |
| 3,259,419 | 7/1966 | Schwarzbach . | |
| 4,077,661 | 3/1978 | Inahashi . | |
| 4,095,833 | 6/1978 | Lewis . | |
| 4,149,746 | 4/1979 | Androski . | |
| 4,185,864 | 1/1980 | Phillips et al. . | |
| 4,195,872 | 4/1980 | Skaalen et al. . | |
| 4,416,480 | 11/1983 | Moody . | |
| 4,709,952 | 12/1987 | Selby | 294/905 |
| 5,108,139 | 4/1992 | Leech . | |
| 5,178,427 | 1/1993 | Jorritsma . | |

*Primary Examiner*—Dean Kramer
*Attorney, Agent, or Firm*—Richard C. Litman

[57] ABSTRACT

A device for remotely opening the safety latch of a hook characterized by an actuating link attached to the safety latch that is selectively movable between a first position, opening the safety latch, and a second position, closing the safety latch. The device further includes actuator, a transmitter and a receiver. The actuator engages the actuating link and selectively moves the actuating link between the first position and the second position. The transmitter transmits operating commands, inputted by the user, to the receiver. The receiver controls the actuator and causes the actuator to selectively move the actuating link between the first position and the second position in response to operating commands from the transmitter.

12 Claims, 4 Drawing Sheets

AUTOMATIC CRANE HOOK SAFETY LATCH

BACKGROUND OF THE INVENTION

1. Field of the Invention

The present invention relates to hoist hooks. More particularly, the present invention relates to a device for remotely actuating the safety latch associated with a crane or hoist hook.

2. Description of the Prior Art

Crane and hoist hooks typically include a safety latch which closes the hook opening to prevent the load supported by the hook from accidentally coming off the hook. The safety latch is normally biased across the hook opening by a latch spring to prevent disengagement of the load from the hook, particularly in the event the hook line goes slack due to the load colliding with another surface. The hook, however, must eventually be released from the load after the load is positioned on the proper surface and, when this surface is not readily accessible, release of the hook becomes difficult. This is particularly true in the construction of large buildings, where reaching the hook to manually disengage the safety latch can often be dangerous and time consuming.

As a result, many workers tie back the safety latch on the hook so that the hook remains open, thereby eliminating the need to manually release the hook once it is properly positioned. This practice is known in the trade as "mousing the latch". Tying the safety latch back violates many safety regulations and is a dangerous and unsafe practice.

Devices for remotely actuating the safety latch of crane and hoist hooks are known in the art. Examples of such devices are seen in U.S. Pat. No. 4,195,872, issued to Clifford I. Skaalen on Apr. 1, 1980, and U.S. Pat. No. 5,108,139, issued to Kenneth E. Leech on Apr. 28, 1992. Skaalen shows a safety latch operating device having a tension cable swivelly attached to the safety latch. The cable extends through a hole in the shank of the hook and is connected to a tag line for remote operation of the safety latch. Leech shows a safety latch operating device having an L-shaped latch which is attached to the hook and which carries a pulley for supporting a cable adapted to attach to the safety latch. The cable attaches to a rope for remote actuation of the safety latch. Both Skaalen and Leech require at least two people to operate the safety latch of the hook—one person to control the movement of the hook, typically from within the crane cab, and one person to operate the cable controlling the safety latch. Also, the person operating the cable is often required to stand in a dangerous location—below the load being lifted by the hoist hook. For these reasons, there is a need for a device which will enable the operators of cranes and hoists to automatically open and close the safety latch on their hook.

Pneumatically and hydraulically operated hoist hooks are well known in the art. Examples of such hooks are seen in U.S. Pat. No. 4,077,661, issued to Kiichiro Inchashi on Mar. 7, 1978; U.S. Pat. No. 4,095,833, issued to Charles B. Lewis on Jun. 20, 1978; U.S. Pat. No. 4,185,864, issued to Lawrence M. Phillips on Jan. 29, 1980; U.S. Pat. No. 4,416,480, issued to Jack M. Moody on Nov. 22, 1983; and U.S. Pat. No. 5,178,427, issued to Johannes N. Jorritsma on Jan. 12, 1993. None of the above referenced teach or suggest an automatic crane hook safety latch having an actuating means controlled by a command signal from a transmitter.

U.S. Pat. No. 3,259,419, issued to Henry E. Schwarzbach on Jul. 5, 1966, shows a releasable hoist hook having a remotely controlled release means for automatically removing the load from the hook. The release means may be electrical, hydraulic, pneumatic, or mechanical. To activate the release means, an insulated coil extends from the hook to the remote control station. The hook taught in Schwarzbach lacks a safety-latch biased across the hook opening by a latch spring to prevent disengagement of the load from the hook. Also, Schwarzbach does not teach or suggest an automatic crane hook safety latch having an actuating means controlled by a command signal from a transmitter.

U.S. Pat. No. 4,149,746, issued to Edward C. Androski on Apr. 17, 1979, shows a remote-controlled safety hook assembly. The hook taught in Androski also lacks a safety-latch biased across the hook opening by a latch spring to prevent disengagement of the load from the hook. In addition, Androski also does not teach or suggest an automatic crane hook safety latch having an actuating means controlled by a command signal from a transmitter.

None of the above inventions and patents, taken either singly or in combination, is seen to describe the instant invention as claimed.

SUMMARY OF THE INVENTION

The present invention is directed to a device for remotely opening the safety latch of a hook. The device is characterized by an actuating link attached to the safety latch that is selectively movable between a first position, opening the safety latch, and a second position, closing the safety latch. The device further includes actuating means, a transmitter and a receiver. The actuating means engages the actuating link and selectively moves the actuating link between the first position and the second position. The transmitter transmits operating commands, inputted by the user, to the receiver. The receiver controls the actuating means and causes the actuating means to selectively move the actuating link between the first position and the second position in response to operating commands from the transmitter.

The present invention offers numerous advantages over the prior art. For example, as the safety latch can be opened and closed remotely by the crane operator, loads can be removed from the hook without extra manpower, resulting in operational savings in labor and in scheduled unloading time, as well as a potential insurance savings because the danger associated with unlatching loads in elevated areas is eliminated. Also, the present invention allows the user to more easily cooperate with construction safety regulations, as workers will no longer be tempted to tie back the safety latch on their hooks. Most importantly, the work environment will be safer, as the risk of falling loads inadvertently disconnected from the hook will be eliminated.

Accordingly, it is a principal object of the invention to provide a device which enables operators of cranes and hoists to automatically open and close the safety latch on their crane hooks.

It is another object of the invention to provide a device for automatically opening and closing the safety latch of a hook that is operated by a command signal from a transmitter.

It is a further object of the invention to provide a device for automatically opening and closing the safety latch of a hook that can be easily retrofitted to existing crane and hoist hooks.

Still another object of the invention is to provide a device for automatically opening and closing the safety latch of a hook that is sized to fit a range of different hook sizes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
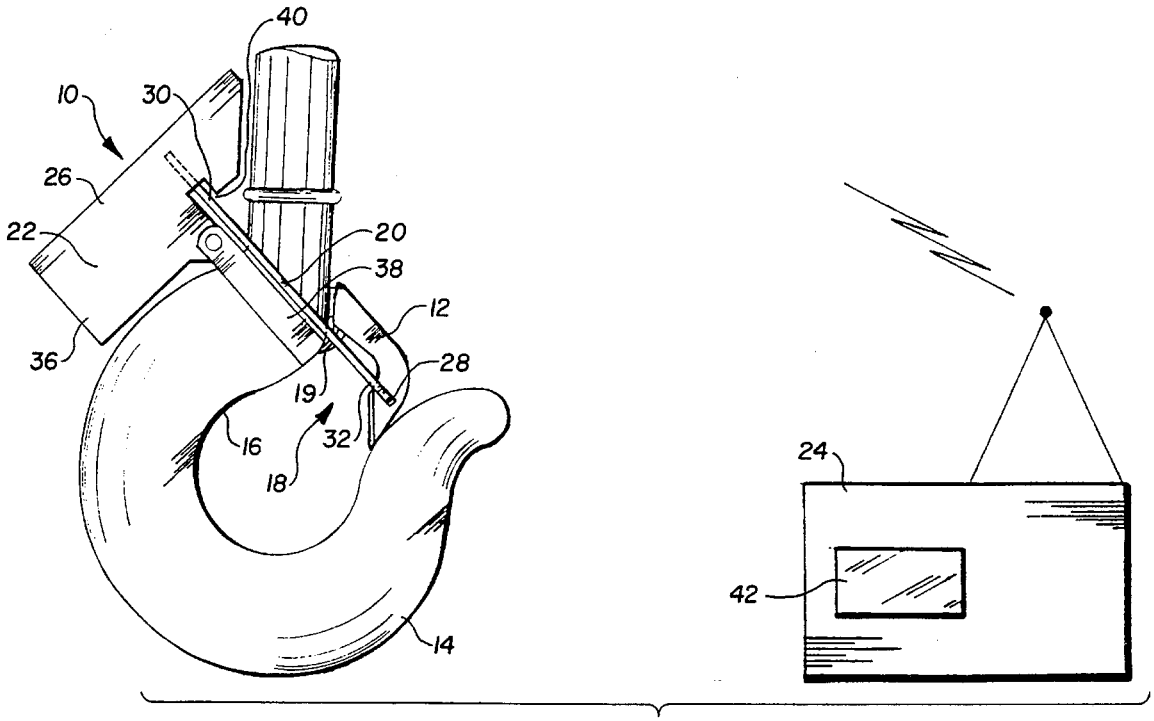
FIG. 1 is a side elevational, environmental view of the present invention, showing the invention mounted on a hook having a safety-latch.

A device 10 for remotely opening a safety latch 12 of a crane or hoist hook 14 is shown in FIG. 1. The safety latch 12 is pivotally attached to the inside surface 16 of the hook 14 such that the safety latch 12 is movable between an open position and a closed position. In the closed position, the safety latch 12 extends across the opening 18 in hook 14 thereby preventing loads being carried by the hook 14 from becoming dislodged from the hook 14. In the open position, the safety latch 12 is positioned adjacent the inside surface of the hook 14 thereby permitting the removal of loads from the hook 14. A latch spring 19 biases the safety latch 12 to the closed position. FIG. 1 shows the safety latch 12 in the closed position.

The main components of the device 10 include an actuating link 20, an actuating means 22, a transmitter 24, and a receiver 26. The actuating link 20 engages the safety latch 12 at an attachment point 28. In the present embodiment of the device 10, a first hole (not shown) is formed in the safety latch 12 and is aligned with a corresponding second hole (not shown) in actuating link 20. A pivot pin (not shown) passes through the second hole to engage the first hole and secure the actuating link 20 to the safety latch 12, while also permitting actuating link 20 to pivot about attachment point 28. Alternative fastening means are possible as long as the actuating link 20 is permitted to pivot about the attachment point 28.

The actuating link 20 is selectably movable between a first position and a second position. In the first position, the actuating link 20 moves the safety latch 12 into the open position. In the second position, the actuating link 20 moves the safety latch into the closed position. The actuating means 22 engages the actuating link 20 and selectively moves the actuating link 20 between the first and second positions. The actuating means 22 moves the rear portion 30 of the actuating link 20 along a linear axis. (See FIG. 1) Because the attachment point 28 moves along an arc as the safety latch 12 moves between the open and the closed positions, the front portion 32 of the actuating link 20 moves in and out of alignment with the axis along which the rear portion 30 of the actuating link 20 moves. Therefore, the front portion 32 of the actuating link 20 should be constructed of a sufficiently flexible material to allow the link to accommodate the arcuate motion of the attachment point 28. For example, the front portion 32 of the actuating link 20 may be constructed of a woven steel cable which is soldered to the rear portion 30 of the actuating link 20 which, in turn, is constructed in the form a of a rigid, steel rod.

The actuating means 22 may be any well known electrical, mechanical, hydraulic, or pneumatic device, such as a linear or rotary servo device having a pinion engaging a rack disposed along rear portion 30 of actuating link 20. Preferably, the actuating means 22 contains a biasing means, such as a spring, to bias the actuating link 20 to the second position. Thus, the safety latch 12 is also biased to the closed position. If the actuating means 22 includes such a biasing means, the latch spring 19 is no longer necessary.

The transmitter 24 produces an operating command, in the form of a signal, when activated by the user. Preferably, a wireless transmitter is used such that the signal produced by the transmitter 24 is in the form of wireless energy, such as laser, infrared, or microwave energy or radio waves. Even more preferably, the transmitter 24 produces a coded wireless signal such that multiple transmitters 24 and receivers 26 can be used at a single location. The receiver 26 controls the actuating means 22 and causes the actuating means 22 to selectively move the actuating link 20 to the first position and to the second position in response to the operating commands from the transmitter 24. Such transmitters and receivers are well known in the art and will not be described herein in detail.

Receiver 26 and actuating means 22 are preferably housed together in a single housing 36. Even more preferably, housing 36 is constructed of a rigid and durable material such that moisture and potential impacts to the housing 36 will not damage the internal components. The housing 36 is secured to the hook 14 by a collar 38. The housing 36 includes a slot 40 through which the rear portion 30 of the actuating link 20 extends to engage the actuating means 22 (see FIG. 1).

Figure 2:
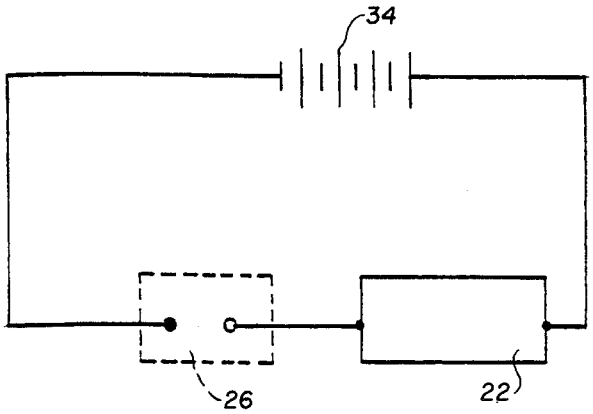
FIG. 2 illustrates an electrical circuit diagram for the invention as shown in FIG. 1.

FIG. 2 shows the electrical configuration of the actuating means 22, the receiver 26 and a power source 34. The receiver 26 is connected in series with the power source 34 and the actuating means 22. The power source 24 is preferably in the form of two rechargeable nickel-cadmium batteries, however, the power source 34 can be any well known power source.

In operation, the housing 36, including the actuating means 22, the actuating link 20, and the receiver 26, are mounted upon the hook 14 by means of the collar 38. The front portion 32 of the actuating link 20 is pivotally attached to the safety latch 12. Two pushes of the button 42 on the transmitter 24 sends a first command signal to the receiver 26. In response to the first command signal, the receiver 26 causes the actuating means 22 to move the actuating link 20 to the first position, thereby moving the safety latch 12 to the open position. The safety latch 12 is held open by the actuating link 20 for a fifteen second cycle, after which the actuating means 22 moves the actuating link 20 to the second position, thereby moving the safety latch 12 to the closed position. Alternatively, a single push of the transmitter button 42, sends a second command signal to the receiver 26. In response to the second command signal, the receiver 26 causes the actuating means 22 to move the actuating link 20 to the second position, thereby moving the safety latch 12 to the closed position. To insure that the safety latch 12 remains in the closed position, the actuating means 22 moves the actuating link 20 to the second position every second outside of the fifteen second cycle. Also, the safety latch 12 may be manually moved between the open and closed positions anytime outside of the fifteen second cycle.

Figure 3:
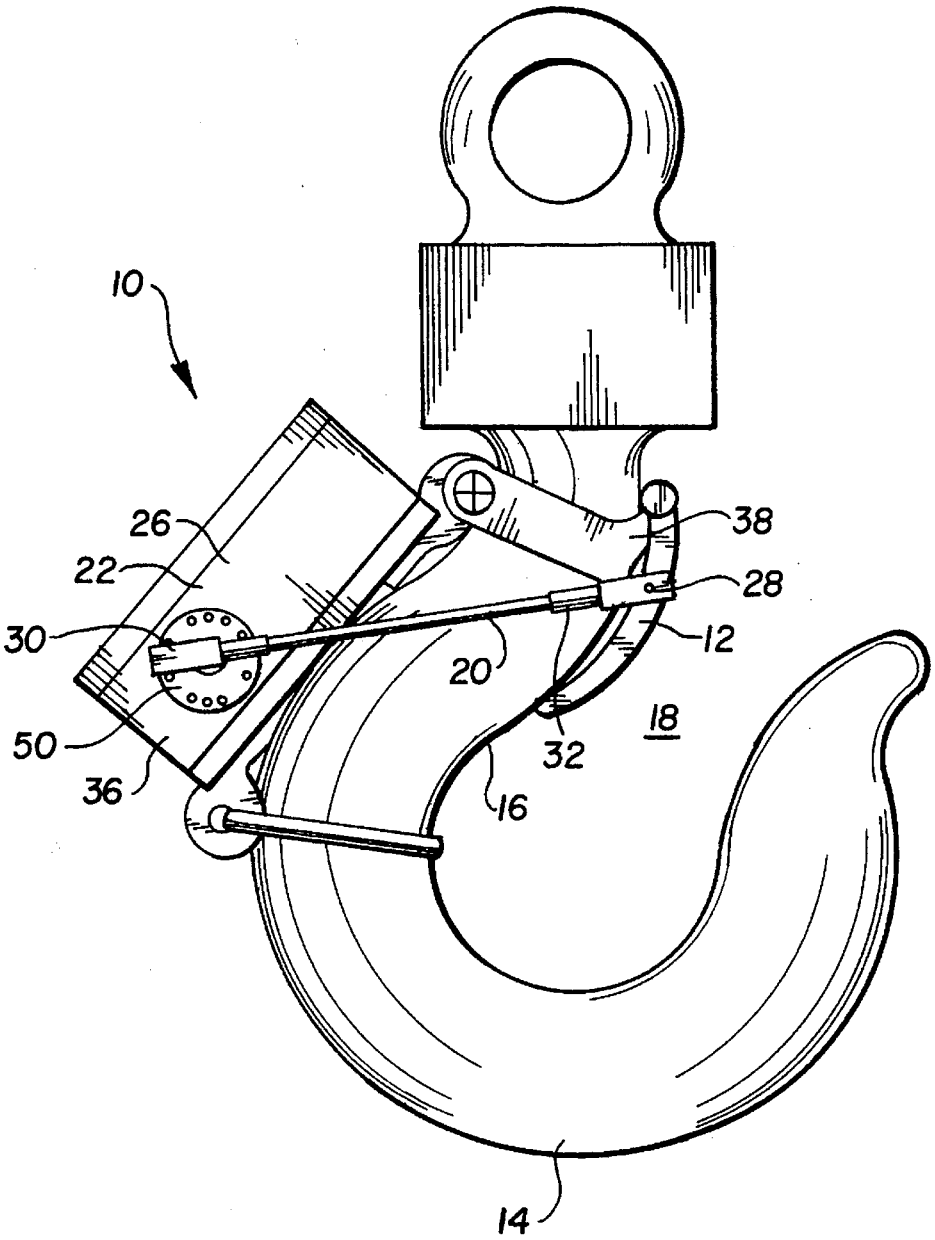
FIG. 3 is a side elevational, environmental view of a second embodiment of the present invention, showing the second embodiment of the invention mounted on a hook having a safety-latch and showing the safety-latch in the open postion.
Figure 4:
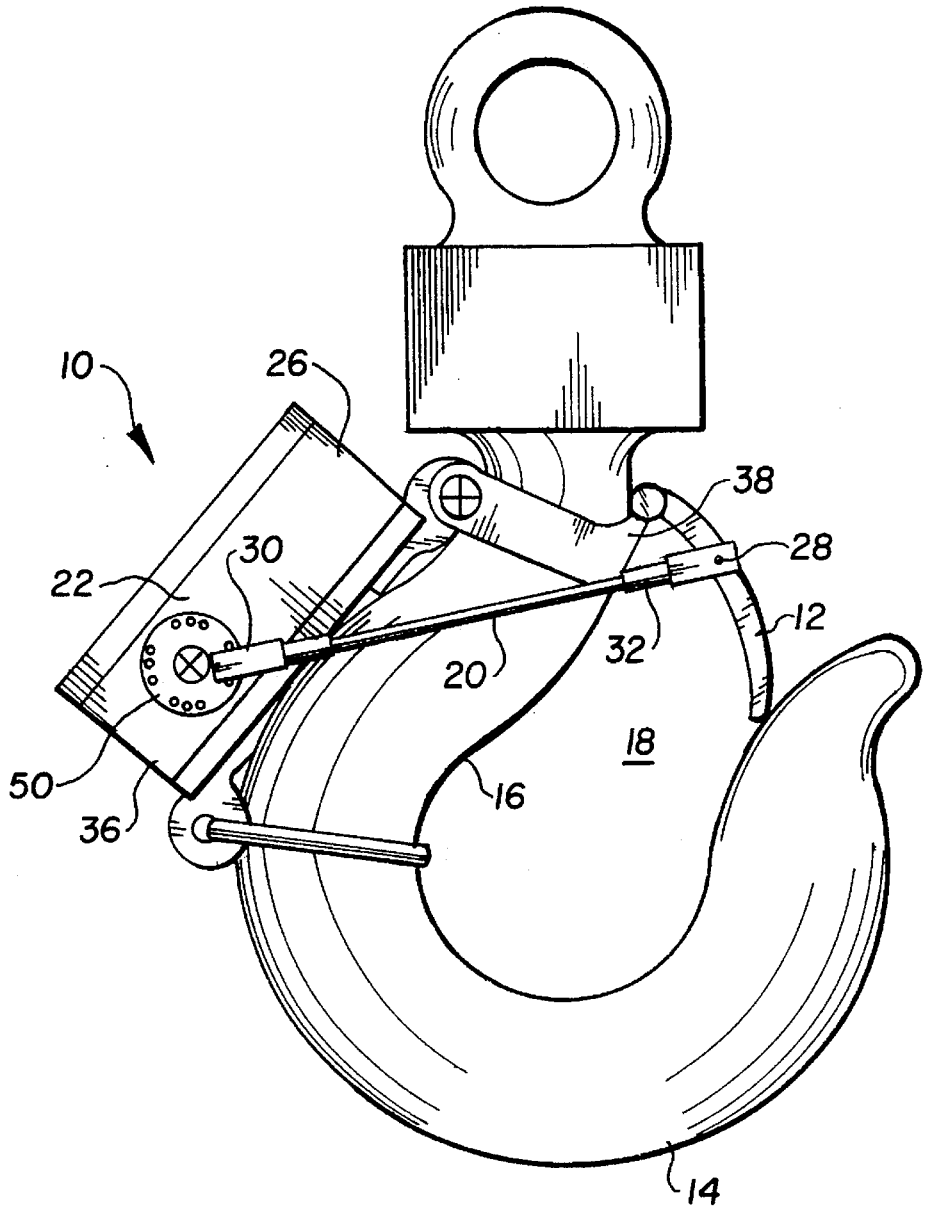
FIG. 4 is a side elevational, environmental view of a second embodiment of the present invention, showing the second embodiment of the invention mounted on a hook having a safety-latch and showing the safety-latch in the closed position.

A second embodiment of the device 10 is shown in FIGS. 3–4. In the second embodiment, the actuating means 22 is a rotary eccentric crank 50 rotated by means of a servo motor. The crank 50 is pivotally attached to the rear portion 30 of the actuating link 20. The actuating means 22 selectively rotates the eccentric crank 50 causing the actuating link 20 to move between the first position and the second position. FIG. 3 shows the actuating link 20 in the first position and the safety latch 12 in the open position. FIG. 4 shows the actuating link 20 in the second position and the safety latch 12 in the closed position.

Figure 5:
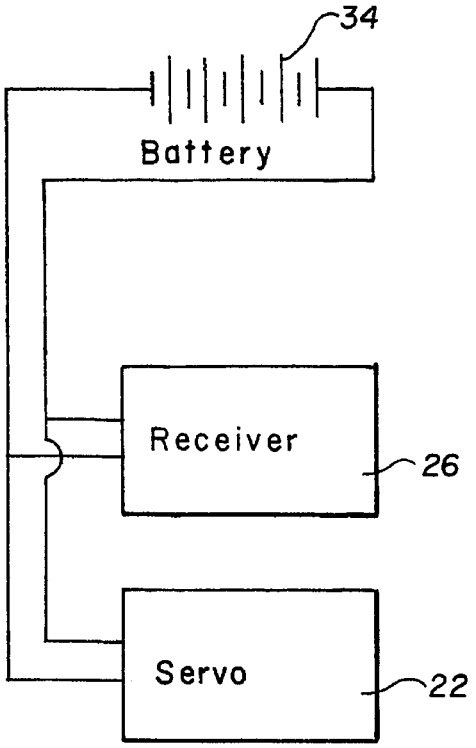
FIG. 5 illustrates an electrical circuit diagram for the invention as shown in FIG. 3.

FIG. 5 shows the electrical configuration of the actuating means 22, the receiver 26 and a power source 34 used with the second embodiment of the device 10. The receiver 26 is connected in series with the power source 34 and in parallel with the actuating means 22.

Figure 6:
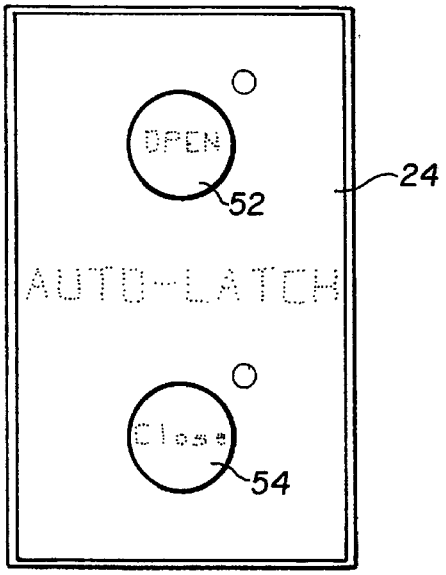
FIG. 6 illustrates a transmitter for use with the invention as shown in FIG. 3.

FIG. 6 shows the transmitter 24 used with the second embodiment of the device 10. The transmitter 24 includes an open push-button 52 and a close push-button 54. Pressing the open push-button 52 causes the transmitter to transmit the first command signal. Pressing the close push-button 54 causes the transmitter to transmit the second command signal.

It is to be understood that the present invention is not limited to the embodiments described above, but encompasses any and all embodiments within the scope of the following claims.

We claim:

1. A remotely operated safety latch device for a hook, said device comprising:

a safety latch movable between an open and a closed position;

an actuating link attached to said safety latch, said actuating link selectively movable between a first position and a second position, said safety latch being in the open position when said actuating link is in said first position and said safety latch being in the closed position when said actuating link is in said second position;

actuating means engaging said actuating link and selectively moving said actuating link to said first position and to said second position;

a collar for attaching said safety latch and said actuating means to a hook, said actuating means attached to said collar, and said safety latch pivotally attached to said collar;

a transmitter for transmitting operating commands inputted by a user; and a receiver controlling said actuating means and causing said actuating means to selectively move said actuating link to said first position and to said second position in response to said operating commands.

2. The device according to claim 1, wherein said transmitter transmits wireless operating commands to said receiver.

3. The device according to claim 2, wherein said transmitter transmits said wireless operating commands in the form of infrared energy.

4. The device according to claim 2, wherein said transmitter transmits said wireless operating commands in the form of microwave energy.

5. The device according to claim 2, wherein said transmitter transmits said wireless operating commands in the form of laser energy.

6. The device according to claim 2, wherein said transmitter transmits said wireless operating commands in the form of radio waves.

7. The device according to claim 1, wherein said actuating link is pivotally attached to the safety latch at an attachment point, said attachment point moving in an arc as the safety latch is moved between the open position and the closed position by said actuating link.

8. The device according to claim 7, wherein said attachment point has an arcuate motion in response to the safety latch moving between the open position and the closed position, said actuating link including a flexible first portion and a rigid rear portion such that said actuating link can accommodate said arcuate motion of said attachment point.

9. The device according to claim 1, wherein said receiver and said actuating means are housed in a rigid housing, said rigid housing attaching said actuating means to said collar.

10. The device according to claim 1, wherein said actuating means is a rotary eccentric crank, said rotary eccentric crank being rotated by means of a servo motor.

11. A device for remotely opening a safety latch of a hook, the safety latch being movable between an open and a closed position, said device comprising:

an actuating link pivotally attached to the safety latch at an attachment point, said actuating link selectively movable between a first position and a second position, the safety latch being in the open position when said actuating link is in said first position and the safety latch being in the closed position when said actuating link is in said second position, said attachment point moving in an arc as the safety latch is moved between the open position and the closed position by said actuating link, said attachment point having an arcuate motion in response to the safety latch moving between the open position and the closed position, said actuating link including a flexible first portion and a rigid rear portion such that said actuating link can accommodate said arcuate motion of said attachment point;

a rotary eccentric crank engaging said actuating link and selectively moving said actuating link to said first position and to said second position, said rotary eccentric crank being rotated by means of a servo motor;

a transmitter for transmitting operating commands inputted by a user; and a receiver controlling said servo motor and causing said servo motor to selectively move said actuating link to said first position and to said second position in response to said operating commands.

12. A device for remotely opening a safety latch of a hook, the safety latch being movable between an open and a closed position, said device comprising:

an actuating link pivotally attached to the safety latch at an attachment point, said actuating link selectively movable between a first position and a second position, the safety latch being in the open position when said actuating link is in said first position and the safety latch being in the closed position when said actuating link is in said second position, said attachment point moving in an arc as the safety latch is moved between the open position and the closed position by said actuating link, said attachment point having an arcuate motion in response to the safety latch moving between the open position and the closed position, said actuating link including a flexible first portion and a rigid rear portion such that said actuating link can accommodate said arcuate motion of said attachment point;

actuating means engaging said actuating link and selectively moving said actuating link to said first position and to said second position;

a transmitter for transmitting operating commands inputted by a user; and a receiver controlling said servo motor and causing said servo motor to selectively move said actuating link to said first position and to said second position in response to said operating commands.

* * * * *